US005705209A

United States Patent [19]

Wright et al.

[11] Patent Number: 5,705,209

[45] Date of Patent: Jan. 6, 1998

[54] INSERT FOR CARBONATED BEVERAGE CONTAINER

[75] Inventors: Timothy Wright, Solihull; Mark Erich Sillince, Bedfordshire, both of United Kingdom; Erwin Anton Rosens, Alphen a/d Rijn, Netherlands

[73] Assignees: Whitbread PLC, London, United Kingdom; Heineken Technical Services B.V., Amsterdam, Netherlands

[21] Appl. No.: 591,672

[22] PCT Filed: Aug. 11, 1994

[86] PCT No.: PCT/GB94/01755

§ 371 Date: Jan. 30, 1996

§ 102(e) Date: Jan. 30, 1996

[87] PCT Pub. No.: WO95/05325

PCT Pub. Date: Feb. 23, 1995

[30] Foreign Application Priority Data

| | | | |
|---|---|---|---|
| Aug. 12, 1993 | [GB] | United Kingdom | 9316732 |
| Jan. 21, 1994 | [GB] | United Kingdom | 9401168 |
| Jul. 7, 1994 | [GB] | United Kingdom | 9413741 |

[51] Int. Cl.[6] ..... B65B 31/00; B65B 17/00; B65B 25/00

[52] U.S. Cl. ..... 426/112; 426/115; 426/118; 426/124; 426/131; 53/420; 53/432; 220/521; 220/906

[58] Field of Search ..... 426/112, 115, 426/118, 124, 131, 394, 397, 398, 474, 477; 53/420, 432, 433, 471, 474, 906; 220/501, 521

[56] References Cited

U.S. PATENT DOCUMENTS

| | | | |
|---|---|---|---|
| D. 367,008 | 2/1996 | Sillince et al. | D9/456 |
| D. 374,176 | 10/1996 | Sillince et al. | D9/337 |
| 4,524,805 | 6/1985 | Hoffman | 137/846 |
| 4,627,986 | 12/1986 | Bardsley et al. | 426/112 |
| 5,584,165 | 12/1996 | Wright | 53/432 |

FOREIGN PATENT DOCUMENTS

| | | |
|---|---|---|
| 1066508 | 4/1967 | United Kingdom . |
| 1331425 | 9/1973 | United Kingdom . |

*Primary Examiner*—Carolyn Paden
*Assistant Examiner*—Curtis E. Sherrer
*Attorney, Agent, or Firm*—Sughrue, Mion, Zinn, Macpeak & Seas, PLLC

[57] ABSTRACT

A carbonated beverage container (10, 35, 40) including a hollow insert (1, 20) which floats in the beverage (11). the insert (1, 20) has two one-way valves (6, 7, 28, 29), one (6, 28) of which allows gas from a headspace above the beverage (11) to enter the insert (1, 20), the other (7, 29) allowing gas from the insert (1, 20) to be jetted into the beverage (11) upon opening the container (10, 35, 40). This jet of gas into the beverage (11) causes shear, and the liberation of gas bubbles which form a close-knit creamy head on the beverage (11) once dispensed.

18 Claims, 4 Drawing Sheets

INSERT FOR CARBONATED BEVERAGE CONTAINER

TECHNICAL FIELD

The present invention relates to a beverage container for a carbonated beverage which enables a close-knit creamy head to be formed on the beverage as it is dispensed so that it has an appearance similar to that of a beverage dispensed from draught.

BACKGROUND ART

Such an appearance can be generated by causing shear in the beverage, which encourages the liberation of small bubbles of gas from the beverage, and these gradually separate out to form the head.

GB-A-1266351 discloses a number of beverage containers where a secondary chamber is provided which contains gas charged to a pressure substantially above atmospheric pressure. In one example, the secondary chamber is permanently in communication with the container via a restricted orifice and is charged with gas under pressure at the time of filling of the container. In another example, the secondary chamber is filled with gas and the restricted orifice sealed with gelatine or other non-toxic substance which is intended to retain the gas under pressure within the secondary chamber prior to and during filling but which dissolves after contact with the beverage for a period of time to open the restricted orifice. In a further example, the restricted orifice is provided in a flexible wall of the chamber which is exposed to the pressure in the main body of the container, the arrangement being such that pressure in the main body of the container holds the region of the wall around the restricted orifice sealed against a grommet until the container is opened, whereupon the resultant release of pressure results in the seal being broken and permits the gas under pressure from the secondary chamber to jet into the beverage through the restricted orifice. For a variety of reasons, none of these designs have met with commercial success.

GB-A-2,183,592 discloses a beverage container wherein, instead of gas being jetted from the secondary chamber by way of a restricted orifice, carbonated beverage or carbonated beverage followed by gas, is jetted through a restricted orifice to induce fine bubble formation in the main body of the beverage. This system has been commercialised, but it is widely accepted that jetting gas only rather than carbonated beverage or carbonated beverage followed by gas, provides better bubble nucleation and hence better head formation. GB-A-2,183,592 discloses a number of constructions wherein the secondary chamber may be constructed as an integral part of the beverage container or it may be formed as a discrete insert which is deposited or pushed into a conventional form of can, bottle or carton. Preference is expressed in GB-A-2,183,592 for an insert which is retained in position, for example at the bottom of the container, by an appropriate adhesive or by mechanical means. However, there is described the possibility of using a discrete insert which may be suspended or float in the beverage in the container provided that the restricted orifice is maintained below the surface of the beverage in the container on opening the container. The possibility of loading or weighting the insert to orientate the position of the restricted orifice is described.

EP-A-0,520,646 describes another proposal in which a beverage container has an insert with a restricted orifice which is arranged to jet gas only into the beverage. This insert is charged with gas by inverting the container promptly after it has been filled with beverage and the headspace above the beverage in the container pressurised so that the restricted orifice is exposed to pressure within the headspace above the beverage in the inverted container. Failure to ensure that the container remains inverted during the pressurization stages, including pasteurisation, results in the insert being filled with a significant amount of beverage, thereby losing all the benefits to be achieved by ejection of gas only under pressure from the insert when the container is opened. In practice, this can occur when there is an unforeseen production line stoppage which results in containers being stopped before inversion. Additionally, during pasteurisation, containers frequently fall over and are pasteurised on their side, in which orientation it is possible for substantial amounts of the beverage to enter the insert, especially since a high pressure exists in the container as a result of heating of the sealed container to the pasteurisation temperature.

WO-A-91/07326 discloses a system in which an insert which jets gas only into the beverage in the main body of the container is pre-pressurized with gas and includes closure means. The closure means remains sealed before filling and during the container filling operation but when the beverage container is subsequently opened, de-pressurization of the beverage container results in the insert releasing a surge of gas from a restricted orifice into the beverage to "seed" the required nucleation of dissolved gas bubbles to produce the required rich creamy foam. This system has met with considerable commercial success. Since the insert is sealed at all material times before the container is finally opened by the consumer the container and insert combination can be filled as easily, simply and quickly as conventional container. A disadvantage of this type of system is that the insert may contain a residual pressure after the container has been emptied. There is a risk a consumer will cut open the empty container and thus be able to interfere with a pressurised insert.

WO-A-91/07326 discloses a very large number of ways in which the pressurized gas insert can be formed and mounted within the beverage container. In most examples, the insert is mounted so that, in use, it is located at a fixed position. However, an example is also described where the insert floats in the liquid in the container.

Although some of the prior art noted above does disclose the general idea of a floating insert none of the commercially adopted systems have used a floating insert. In general most of the systems which have been adopted rely on the insert being in a fixed position either to ensure that it works effectively on opening of the container or to ensure that it is charged with gas during pasteurisation. For example, if the insert described in EP-A-0,520,646 is displaced from its location adjacent the base of the container, when the container is inverted, the restricted orifice is not in the headspace during pressurisation and pasteurisation. Accordingly, the insert is filled with beverage and so does not operate as effectively as possible as a result of jetting liquid rather than gas.

Another problem which occurs with fixed inserts results from the way in which a container is handled during opening. When opening a bottle with a crown cork type closure the bottle is often tipped almost horizontally if opened using a fixed opener. Equally when opening an easy open feature, either a ring pull or a stay-on-tab on a can it is common to tilt the can on opening. In both cases, immediately after opening the closure the container is then tipped to dispense its contents. These actions can result in the restricted orifice of the insert not being immersed in the beverage whilst gas is being jetted from it. In such a case the insert does not function correctly.

SUMMARY OF THE INVENTION

According to the present invention, a carbonated beverage container includes a floating hollow insert having valve means, characterised in that the valve means includes a first one-way valve arranged to allow gas to enter the insert, and a second one-way valve arranged to allow gas to be jetted from the insert, and in that the insert is arranged to float on the beverage with the first one-way valve in a headspace above the beverage, and with the second one-way valve below the surface of the beverage.

The present invention provides a beverage container with an insert which jets gas into the beverage through a valve, creating shear and so causing liberation of small bubbles of gas upon opening of the container, yet does not require the insert to be pre-pressurized. As the insert floats on the beverage, the insert may be dropped into the container before or after filling, and therefore the assembly of the container and insert is much simpler than for containers in which the insert is fixed in the container or is an interference fit in the container. As the insert floats, the problems of orientation, including gas not being jetted into the beverage, and beverage entering the insert, which are associated with fixed inserts, are overcome. Further, the nature of the containers is not critical since it is not necessary to form an interference fit with them, or adapt them specifically to hold the insert at a particular location.

At least the second one-way valve is preferably a duckbill valve. Duckbill valves are particularly advantageous as the size of the aperture through which gas is jetted changes with pressure difference across the valve. This ensures that the velocity of gas jetted through the valve is substantially constant during jetting.

The first one-way valve, which is preferably also a duckbill valve, may have a pre-loading, which requires the pressure difference across the valve to exceed a predetermined level for the valve to open. In this way, after the insert has been pressurized,,in the unlikely event of the first one-way valve being submerged below the surface of the beverage, a small pressure difference across the valve created as a result of its immersion for example does not open the valve, and therefore no beverage enters the insert. The second one-way valve may be mounted in the insert so that its inner end is above the bottom of the insert. In this way, in the very unlikely event of any beverage entering the insert, this collects below the opening of the valve, and so is not be jetted into the beverage in the container upon its opening. By ensuring that substantially no beverage is jetted from the insert into the beverage in the container, the head enhancing effect created in the beverage is improved.

The insert may be moulded from a plastics material such as polypropylene, or be formed of metal such as lacquered aluminium, lacquered tin plate, polymer coated aluminium, polymer coated tin plate or tin free steel. Where the insert is made of metal and the container is also made of metal, they are preferably both made of the same metal to facilitate recycling. In the case of a plastics insert, the insert is preferably moulded in two parts which are snap-fitted or welded together. Preferably the insert has two substantially hemi-spherical ends connected by a substantially tubular portion, with the two one-way valves being provided in the curved walls of the tubular portion of the insert, and is arranged to float with its longitudinal axis parallel to the surface of the beverage. This is particularly advantageous as the insert is easily able to rotate into the required orientation with the second one-way valve below the surface of the beverage. This shape is advantageous for a floating insert. By controlling its buoyancy a large volume of gas can be contained within the insert, whilst it is arranged to float with only a small amount of the insert being above the surface of the beverage. With the insert arranged in this way, only a small headspace is required, and this enables the insert to be used with conventional containers and does not require the "oversize" containers used with most head enhancing inserts.

The insert preferably includes a deformable portion so that, in its non-deformed state, the insert does not block or pass through a dispensing aperture of the container, and in its deformed state can be inserted into the container via the dispensing aperture. The deformable portion preferably comprises a protrusion formed integrally with the remainder of the insert. The insert may be made from a resilient material, and be thin enough for it to be deformed around the protrusion or, alternatively the protrusion may be surrounded by a thinned or weakened portion. The first one-way valve is preferably located in the protrusion. This thus increases its freeboard so assisting it in remaining above the surface of the beverage.

Alternatively, where the hollow insert is manufactured from metal, it preferably has a substantially circular base in which is mounted the second one-way valve, and an inverted cup shaped upper part which forms the side walls and top. The first one-way valve is mounted in the top. The side walls of the insert are preferably flared outwardly towards the bottom and the base received in this outwardly flared portion and held in place by rolling the bottom of the side walls to form an annular recess. In this case, it is advantageous to include a sealing material such as a can seal lining compound in the annular recess to seal the two parts of the insert together. Further, the compound covers the cut edges of the base and side walls, preventing these from corrosion which may otherwise impair the flavour of the beverage.

The base of the insert preferably includes an annular indented portion arranged towards the outside of the base. This is used to centre the base with respect to the side wall of the insert.

The valves are mounted through holes in the top and base of the insert, the holes preferably having a diameter slightly smaller than the outside diameter of the valves. In this way, the edges of the holes bite into the elastomeric valves to some extent, and this protects the cut edges and prevents them contacting the beverage and corroding.

Preferably the insert is arranged so that its second valve is always below the surface of the beverage by providing orientating means, symmetrically arranged relative to the second valve. The insert is preferably symmetrical about a vertical axis with the first and second valve being located on this axis. The orientation means may have a positive or negative buoyancy relative to the beverage in which it is used. However, it is preferred that the material from which the insert is made has a negative buoyancy and that the base of the insert has a greater wall thickness.

The effective volume of the inside of the insert is preferably between 2 and 7 ml, depending upon the size of the container, and the type of beverage.

BRIEF DESCRIPTION OF DRAWINGS

Particular examples of the present invention will be described with respect to the accompanying figures in which.

DETAILED DESCRIPTION OF PREFERRED EMBODIMENTS

Figure 1:
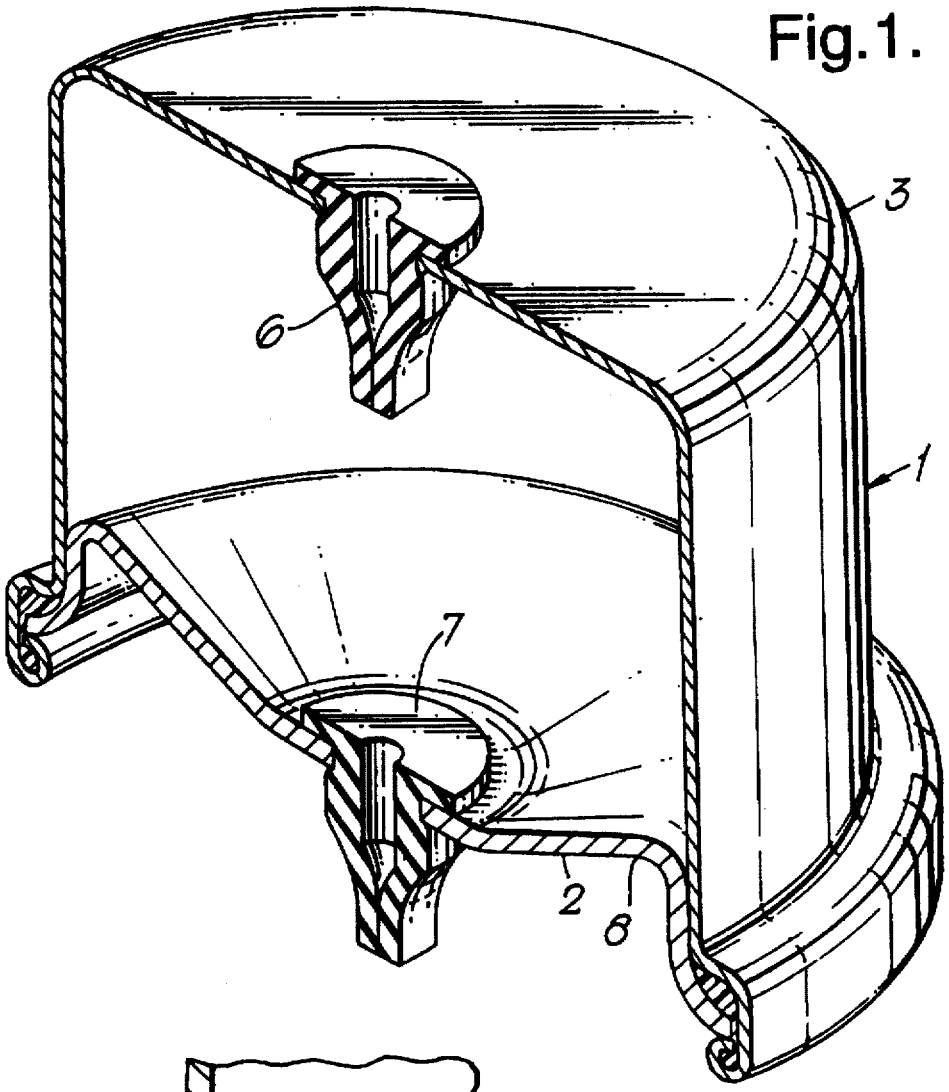
FIG. 1 shows a sectioned perspective view of a first example of an insert for use in a container according to the present invention.

FIG. 1 shows a sectioned perspective view through a first example of an insert for a container according to the present invention. The insert 1 is made from lacquered aluminium and is designed for use in an aluminium container to facilitate recycling. The insert 1 has a circular base 2. The base 2 has a thickness of between 0.5 and 1 mm. The sides and top 3 of the insert 1 are integrally formed in an inverted cup shape from aluminium of 0.2 mm thickness. The thicker aluminium of the base 2 means that the insert 1 floats with the base 2 lowermost. A first one-way valve 6 is mounted in the top of the insert, and a second one-way valve 7 is mounted in the base 2.

Figure 2:
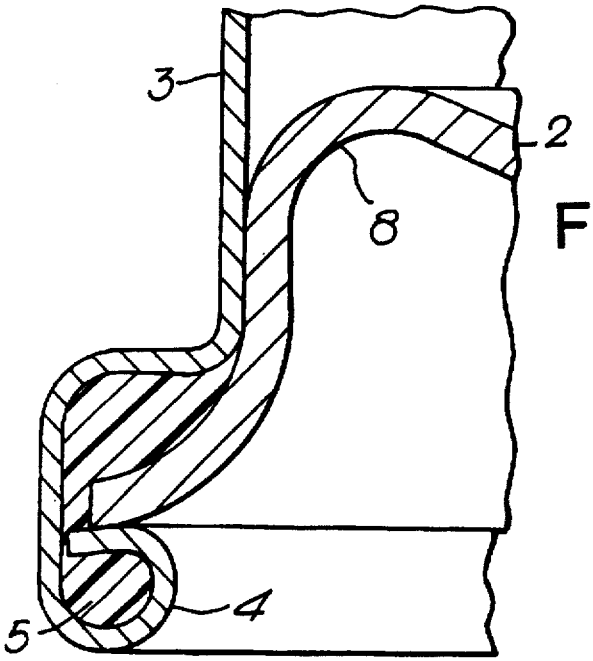
FIG. 2 shows an enlarged sectional view of a portion of the insert of FIG. 1.

As shown more clearly in FIG. 2, the side walls are flanged outwardly towards the bottom for receiving the base 2, and the edge 4 is rolled over to hold the base 2 in position. The base 2 has an indented annular portion 8, which is arranged towards the outside of the base 2. This is used to centre the base 2 with respect to the side walls of the insert 1. A sealing material 5 such as a foamed can seal lining compound is used to seal the side walls and base. This has two functions. Firstly, the compound seals the base 2 against the rolled end 4 of the side walls, thereby sealing and retaining the base 2 in position. Secondly, the compound 5 covers the cut edges of the base 2 and the side walls. This protects the cut edges, and prevents these from corroding, which would otherwise impair the taste of the beverage.

Both the one-way valves 6,7 are TPE duckbill valves. The holes for the valves 6,7 are of a slightly smaller diameter than the diameter of the tubular body portion of the duckbill valves 6,7, so that the edges of the hole bite into the valve 6,7. This helps retain the valve 6,7, and prevents the cut edges of the insert 1 from being exposed to the beverage and corroded. The valves 6,7 include an annular rib and a flange, which are positioned on either side of the hole to retain the valves 6,7.

The internal volume of the insert 1 depends upon the beverage 11 contained in the can 10, but is typically between 2 ml and 7 ml.

Figure 3:
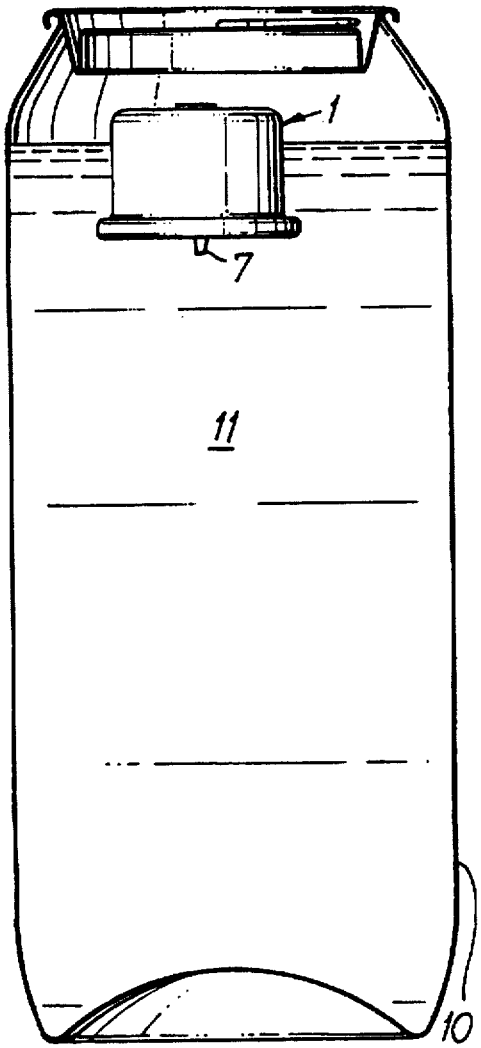
FIG. 3 shows a cross-section of a can containing a beverage, and the insert of FIG. 1.

FIG. 3 shows the insert 1 as described above in a can 10 containing a carbonated beverage 11. When filling the can 10, the insert 1 is dropped into the can 10, and the can 10 and insert 1 are together flushed with inert gas to remove any oxygen from the inside of both can 10 and insert 1. The can 10 is then filled with carbonated beverage 11, dosed with liquid nitrogen, and sealed. After sealing the can 10, the contents are heated to pasteurise the beverage 11.

During heating, the pressure in the can 10 increases. The increase in pressure causes the first one-way valve 6 to open and gas from the headspace to enter the insert 1. The internal pressure of the insert 1 does not exceed the internal pressure of the can 10, so the second one-way valve 7 remains closed. After pasteurisation, the beverage 11 cools and the internal pressure of the can 10 decreases. The internal pressure of the insert 1 then exceeds the internal pressure of the can 10, and the second one-way valve 7 opens allowing gas from the insert 1 to be ejected into the beverage 11. In this way, the internal pressure of the can 10 and the insert 1 remain in equilibrium.

Upon opening of the can 10, the internal pressure of the can 10 rapidly vents to atmospheric pressure. At this time, the internal pressure of the insert 1 is higher than that of the can 10, and accordingly gas from the insert 1 is jetted into the beverage 11 via the second duckbill valve 7. The jet of gas causes shear in the beverage 11 with a resulting liberation of a number of small bubbles which, as they rise through the beverage 11 in the can 10, form nucleation sites which trigger the liberation of further small bubbles throughout the beverage 11. As the beverage 11 is poured out of the can 10 and into a receptacle such as a drinking glass the bubbles from the top surface of the beverage are intimately mixed with the remainder of the beverage as it is dispensed. This triggers the release of further small bubbles throughout the beverage to give the appearance of dispensing the beverage 11 from draught.

The use of a duckbill valve 7 for jetting gas is especially beneficial since, as the pressure difference between the inside of the insert 1 and the inside of the can 10 reduces, the size of the aperture of the duckbill valve 7 also reduces, and the velocity of gas jetted into the beverage remains substantially constant until the internal pressures of the insert 1 and can 10 are substantially the same.

Figure 4:
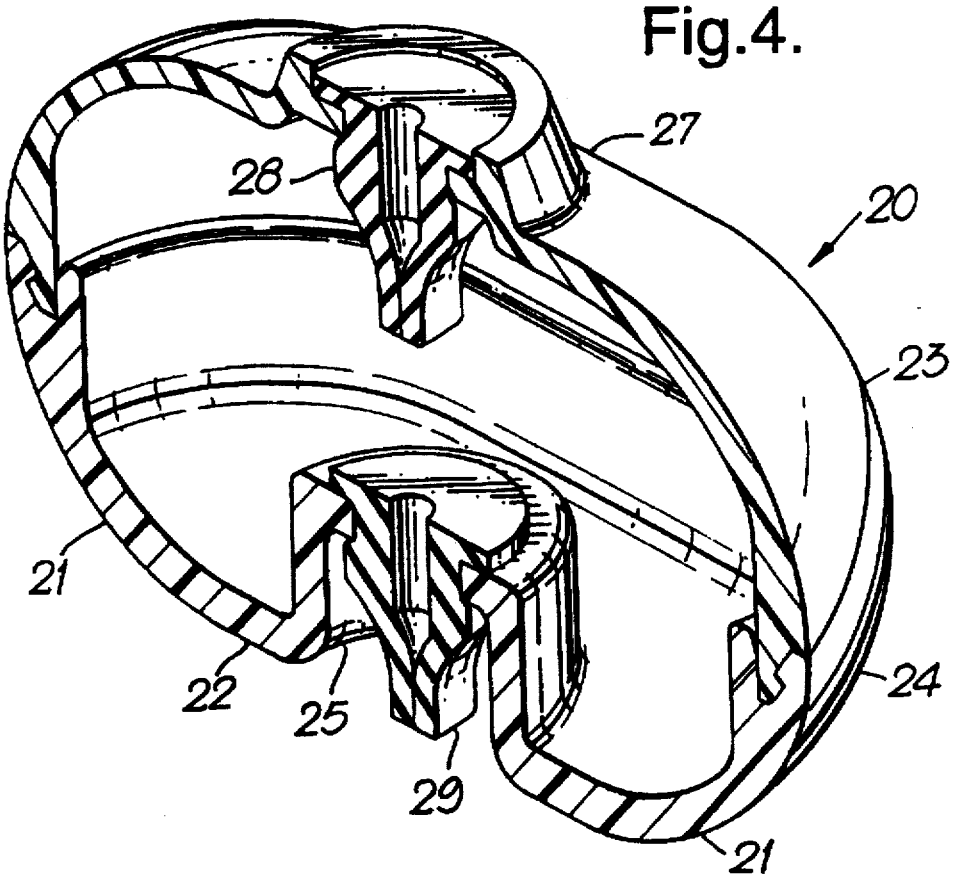
FIG. 4 shows a sectioned perspective view of a second example of an insert for use in a container according to the present invention.
Figure 5:
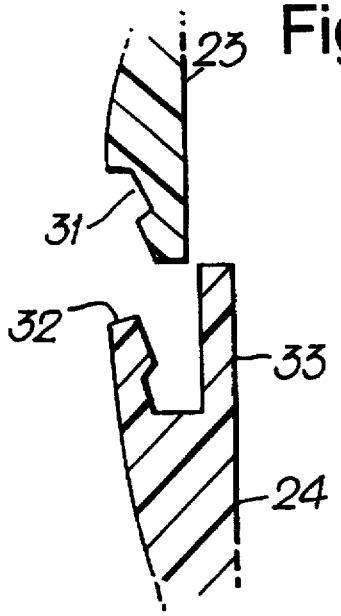
FIG. 5 shows an enlarged sectional view of a portion of the insert of FIG. 4.

FIG. 4 shows a second example of an insert 20 for use in the present invention. This insert 20 is made from plastics, and is especially useful where the container is a bottle.

The insert 20 includes two substantially hemispherical ends 21 joined by a tubular body portion 22. The insert 20 is formed from an upper part 23, and a lower part 24 which are snap fitted together.

The insert 20 includes a deformable portion 27, so that in its non-deformed state, the insert 20 is unable to pass through a dispensing aperture of a container, yet in its deformed state is able to pass through the aperture to allow the insert 20 to be inserted into the container. In this way, it is possible for the insert 20 to easily be inserted into a container, for example through the neck of a bottle, yet, when beverage is dispensed from the container the insert does not block or pass through the dispensing aperture. The deformable portion 27 is a protrusion provided on the upper part 23 of the insert 20. The upper part 23 of the insert 20 is formed entirely of thin plastics material allowing the insert to be deformed, although a weakened portion may alternatively be provided to allow the insert to be deformable. A first valve 28 is mounted in the protrusion 27.

The lower part 24 of the insert 20 is made with a greater wall thickness than the upper part 23 so that the insert 20 tends to float with the lower part 24 lowermost since the plastics material has a negative buoyancy. The lower part 24 includes a central recess 25 in which the second one-way valve 29 is mounted. In this way, the second one-way valve 29 is protected from damage by the walls of the insert 20 which surround the lips of the valve 29. Further, the opening of the second one-way valve 29 inside the insert 20 is above the bottom of the insert 20. In the unlikely event of liquid entering the insert 20, the liquid will be below the height of the opening of the valve 29, and so no liquid will be jetted from the insert 20 when the container is opened.

Figure 6:
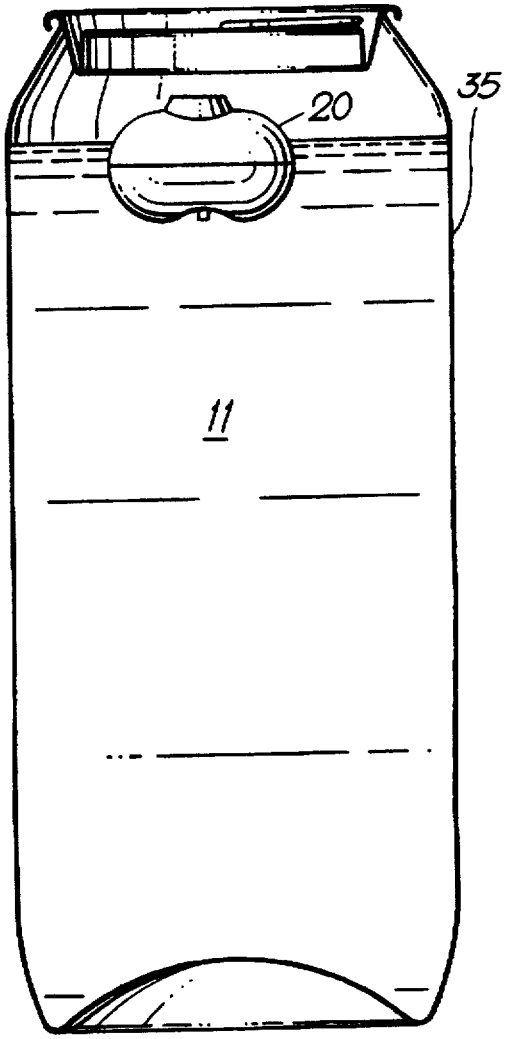
FIG. 6 shows a cross-section of a can containing a beverage, and the insert of FIG. 4.

As shown in FIG. 6, the upper part 23 of the insert 20 includes a circumferential groove 31 around its side wall. The lower part 24 includes a first upstanding rib 32 which is shaped to interlock with the groove 31. This arrangement allows the upper part 23 and the lower part 24 to snap fit together. A second upstanding rib 33 extends from the lower part 24, and contacts the inner face of the side wall of the upper part 23, opposite the circumferential groove 31. When the upper and lower parts 23, 24 of the insert 20 are snap fitted together, the opposed ribs 32, 33 sandwich the side wall of the upper part 23, thereby retaining the two parts 23, 24. When a pressure difference exists between the inside and outside of the insert 20, the ribs 32, 33 prevent radial movement of the side walls of the upper part 23, and thereby prevent the upper and lower parts 23, 24 from disengaging when the insert is subjected to large pressure differences between its inside and outside.

FIG. 6 shows the inclusion of the second example of insert 20 in a can 35.

Figure 7:
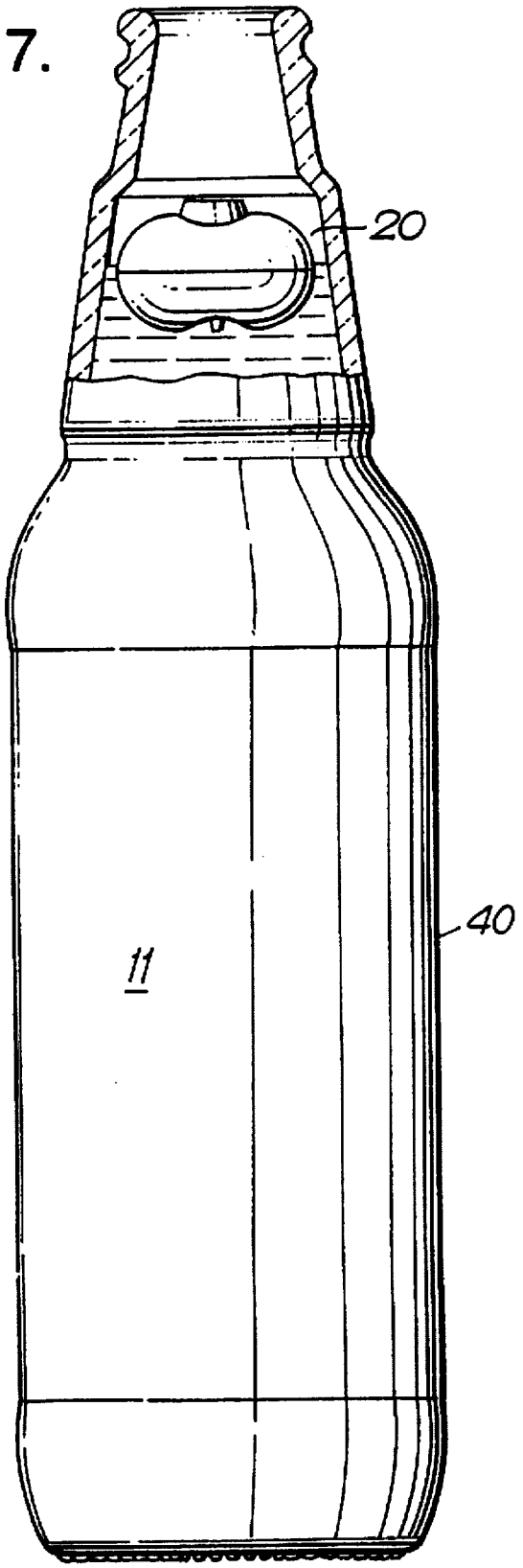
FIG. 7 shows a cross-section of a bottle containing a beverage, and the insert of FIG. 4; and, FIG. 8 shows a non-return valve.

FIG. 7 shows a bottle 40 including the second example of the insert 20. To fill the bottle 40, the insert 20 is deformed and pushed through the neck of the bottle 40. When the insert 20 is in the bottle 40, it returns to its normal state, in which it is too large to fit through the neck of the bottle 40. The bottle 40 and insert 20 are then flushed with inert gas to remove any oxygen, and the bottle 40 is filled with beverage 11, dosed with liquid nitrogen and sealed. The beverage 11 is then heated to pasteurise the beverage 11, and this increases the internal pressure of the bottle 40. As with the first example described above, internal pressure of the insert also increases as gas enters the insert 20 via the first one-way valve 28. When the bottle 40 is opened, the gas inside the insert 20 jets into the beverage 11 causing shear. As the beverage 11 is dispensed, it is not possible for the insert 20 to pass through the neck of the bottle 40, as a result of the projection 27 and so the insert 20 is not accidentally dispensed along with the beverage 11.

Figure 8:
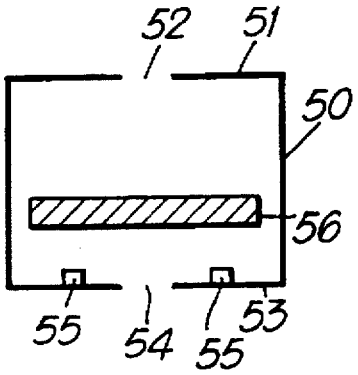

Other valves can be used in place of a duckbill valve. FIG. 8 shows a non-return valve 50 comprising a hollow body having a circular cross-section with an upper end wall 51 having an inlet port 52, and a lower end wall 53 including a restricted orifice 54. The inner surface of the lower end wall has a pair of lugs 55 projecting therefrom. A circular disk valve 56 is provided within the body. When a pressure is exerted from the outside of the body through the restricted orifice 54, the valve disk is urged towards the upper end wall, and seals the inlet port 52 to prevent the flow of gas through the body. When pressure is applied through the inlet port 52, the valve disk 54 urged onto the lugs 55, which prevent the disk 56 from sealing the restricted orifice 54. Accordingly, gas can flow through the valve 50.

We claim:

1. A carbonated beverage container (10, 35, 40) for a beverage the container (10, 35, 40) including a floating hollow insert (1, 20) having valve means (6, 7, 28, 29), characterized in that the valve means includes a first one-way valve arranged to allow gas to enter the insert (1, 20), and a second one-way valve (7, 29) arranged to allow gas to be jetted to the insert (1, 20), and in that the insert (1, 20) is arranged to float on the beverage (11) with the first one-way valve (6, 28) in a headspace above the beverage (11), and with the second one-way valve (7, 29) below the surface of the beverage (11).

2. A carbonated beverage container (10, 35, 40) according to claim 1, in which the second one-way valve (7, 29) is a duckbill valve.

3. A carbonated beverage container (10, 35, 40) according to claim 1, in which the first one-way valve (6, 28) has a pre-loading, so that the pressure difference across the valve (6, 28) must exceed a predetermined level for the valve (6, 28) to open.

4. A carbonated beverage container (35, 40) according to claim 1, in which the insert (20) is molded from a plastics material.

5. A carbonated beverage container (35, 40) according to claim 4, in which the insert (20) is molded in two parts (23, 24) which are snap-fitted or welded together.

6. A carbonated beverage container (35, 40) according to claim 4, in which the insert (20) has two substantially hemispherical ends (21) connected by a substantially tubular portion (22), with the two one-way valves (28, 29) being provided in the curved walls of the tubular portion (22) of the insert (20), and is arranged to float with its longitudinal axis parallel to the surface of the beverage (11).

7. A carbonated beverage container (35, 40) according to claim 1, in which the insert (20) includes a deformable portion (27) so that, in its non-deformed state, the insert (20) does not pass through a dispensing aperture of the container (35, 40), and in its deformed state can be inserted into the container (35, 40) via the dispensing aperture.

8. A carbonated beverage container (35, 40) according to claim 7, in which the deformable portion (27) comprises a protrusion formed integrally with the remainder of the insert (20).

9. A carbonated beverage container (35, 40) according to claim 8, in which the insert (20) is formed from a resilient material, thin enough for it to be deformed around the protrusion.

10. A carbonated beverage container (35, 40) according to claim 8, in which the first one-way valve (28) is located in the protrusion.

11. A carbonated beverage container (10) according to claim 1, in which the container (10) is formed from the same material as the insert (1) to facilitate recycling.

12. A carbonated beverage container (10) according to claim 11, in which the insert (1) is made of metal, and has a substantially circular base (2) in which is mounted the second one-way valve (7), and an inverted cup shaped upper part (3) which forms the side walls and top, in which is mounted the first one-way valve (6).

13. A carbonated beverage container (10) according to claim 12, in which the side walls of the insert (1) are flared outwardly towards the bottom and the base (2) received in this outwardly flared portion and held in place by rolling the bottom (4) of the side walls to form an annular recess.

14. A carbonated beverage container (10) according to claim 13, in which a sealing compound (5) is included in the annular recess.

15. A carbonated beverage container (10) according to any claim 12, in which the base (2) of the insert (1) includes an annular indented portion (8) arranged towards the outside of the base (2) to center the base (2) with respect to the side wall of the insert (1).

16. A carbonated beverage container (10) according to claim 12, in which the first and second one-way valves (6, 7) are mounted through holes having a diameter slightly smaller than the outside diameter of the valves (6, 7).

17. A carbonated beverage container (10, 35, 40) according to claim 1 in which the insert (1, 20) includes orientating means, symmetrically arranged relative to the second valve (7, 29).

18. A carbonated beverage container (10, 35, 40) according to claim 1, in which the insert (1, 20) is symmetrical about a vertical axis with the first and second valve (6, 7, 28, 29) being located on this axis.

* * * * *